US007828392B2

(12) United States Patent
Hall et al.

(10) Patent No.: US 7,828,392 B2
(45) Date of Patent: Nov. 9, 2010

(54) METAL DETECTOR FOR A MILLING MACHINE

(76) Inventors: David R. Hall, 2185 S. Larsen Pkwy., Provo, UT (US) 84606; David Wahlquist, 2185 S. Larsen Pkwy., Provo, UT (US) 84606; Neil Cannon, 2185 S. Larsen Pkwy., Provo, UT (US) 84606

( * ) Notice: Subject to any disclaimer, the term of this patent is extended or adjusted under 35 U.S.C. 154(b) by 204 days.

(21) Appl. No.: 11/837,347

(22) Filed: Aug. 10, 2007

(65) Prior Publication Data

US 2009/0041542 A1 Feb. 12, 2009

(51) Int. Cl.
*E01C 23/088* (2006.01)

(52) U.S. Cl. ..... 299/1.5; 404/84.05

(58) Field of Classification Search ..... 324/326, 324/329, 234, 236, 238, 242, 262; 336/92, 336/96, 84 R, 84 C, 84 M, 229, 225; 299/1.4, 299/1.5, 36.1, 39.1, 39.4; 404/84.05, 90, 404/93, 94

See application file for complete search history.

(56) References Cited

U.S. PATENT DOCUMENTS

| | | | | | |
|---|---|---|---|---|---|
| 2,451,596 | A * | 10/1948 | Wheeler | 324/329 |
| 3,371,272 | A * | 2/1968 | Stanton | 324/207.18 |
| 3,929,377 | A * | 12/1975 | Weaver et al. | 299/1.5 |
| 5,557,206 | A * | 9/1996 | Won | 324/329 |
| 5,607,205 | A * | 3/1997 | Burdick et al. | 299/1.5 |
| 5,786,696 | A | 7/1998 | Weaver | |
| 7,053,788 | B2 * | 5/2006 | Hall et al. | 340/854.4 |
| 7,077,601 | B2 | 7/2006 | Lloyd | |
| 2005/0175412 | A1 * | 8/2005 | Lloyd | 404/77 |

FOREIGN PATENT DOCUMENTS

| | | | |
|---|---|---|---|
| CN | 1455049 | A * | 11/2003 |
| DE | 19518973 | * | 11/1996 |
| JP | 03241105 | A * | 10/1991 |

* cited by examiner

*Primary Examiner*—Sunil Singh
(74) *Attorney, Agent, or Firm*—Tyson J. Wilde; Benjamin T. Miskin; Philip W. Townsend, III

(57) ABSTRACT

A milling machine for milling a paved surface having milling tools connected to an underside of a body of the machine and at least one metal detector attached to a front end of the machine. The metal detector has at least one electrically conductive coil disposed within a magnetically conductive, electrically insulating trough. Electronic equipment is in communication with the metal detector, the equipment being adapted to interpret feedback from the detector.

17 Claims, 9 Drawing Sheets

METAL DETECTOR FOR A MILLING MACHINE

CROSS REFERENCE TO RELATED APPLICATIONS

Background of the Invention

The current invention relates to milling machines for milling asphalt or concrete in roads, sidewalks, parking lots, or other paved surfaces. While milling and resurfacing a paved surface, the milling machines often encounter metal objects which are covered partially or completely by the paved surface such as manhole covers or railroad tracks. In such circumstances, if the metal object isn't detected beforehand, the object, milling tools on the milling machine, or both may be damaged. In order to avoid this, a metal detector may be used to detect the objects before milling the paved surfaces. It may also be advantageous to know the size and depth of the metal objects. Some inventions of the prior art disclose metal detectors in combination with a pavement resurfacing machine.

U.S. Pat. No. 7,077,601 to Lloyd, which is herein incorporated by reference for all that it contains, discloses a machine for providing hot-in-place recycling and repaving an existing asphalt-based pavement, in which the pavement is first heated.

U.S. Pat. No. 5,786,696 to Weaver et al., which is herein incorporated by reference for all that it contains, discloses a metal detector which utilizes digital signal processing and a microprocessor to process buffers of information which is received at a periodic rate. The metal detector is able to determine the depth of a target by comparing the quadrature phase components received from first and second receive antennas. The size of the target is determined by reference to a look-up table based on the depth factor and the signal amplitude determined for the target object.

BRIEF SUMMARY OF THE INVENTION

A milling machine for milling a paved surface having milling tools connected to an underside of a body of the machine and at least one metal detector attached to a front end of the machine. The metal detector has at least one electrically conductive coil disposed within a magnetically conductive, electrically insulating trough. Electronic equipment is in communication with the metal detector, the equipment being adapted to interpret feedback from the detector.

The machine may comprise at least two metal detectors positioned such that a detection range of a first detector extends farther into the surface than a detection range of a second detector. The machine may comprise at least two metal detectors, each adapted to detect metal objects at different depths. The machine may comprise a plurality of metal detectors arranged in a plurality of arrays, each array positioned at a different distance above the paved surface. The machine may comprise a plurality of metal detectors positioned at different angles. The milling tools may be adapted to be automatically laterally adjusted in a closed-loop system by the electronic equipment in response to feedback from the detector.

The metal detector may comprise at least 2 electrically conductive coils disposed within a magnetically conducting, electrically insulating trough. The metal detector may further comprise a second electrically conductive coil disposed within a second magnetically conducting, electrically insulating trough. The first and second troughs may comprise different diameters and/or depths. The metal detector may be adapted to detect metal objects up to 1 foot deep. The metal detector may be adapted to determine the size of a metal object. The metal detector may be vertically adjustable. The metal detector may be attached to the front end such that during operation the detector is positioned from 0.5 to 8 inches above the paved surface. The metal detector may also be positioned within 8 feet of the milling tools. A detection range of the metal detector may be controlled by a variable voltage source.

The magnetically conducting, electrically insulating trough may comprise ferrite, iron, mu-metals, nickel, or combinations thereof. The magnetically conducting, electrically insulating trough may be segmented. The magnetically conducting, electrically insulating trough may comprise a magnetic permeability of at least 100. The coil may be coated with polyketones, PEEK, or other insulating materials. The coil may be circular, rectangular, straight, triangular, ovular, or any polygonal shape.

DETAILED DESCRIPTION OF THE INVENTION AND THE PREFERRED EMBODIMENT

Figure 1:
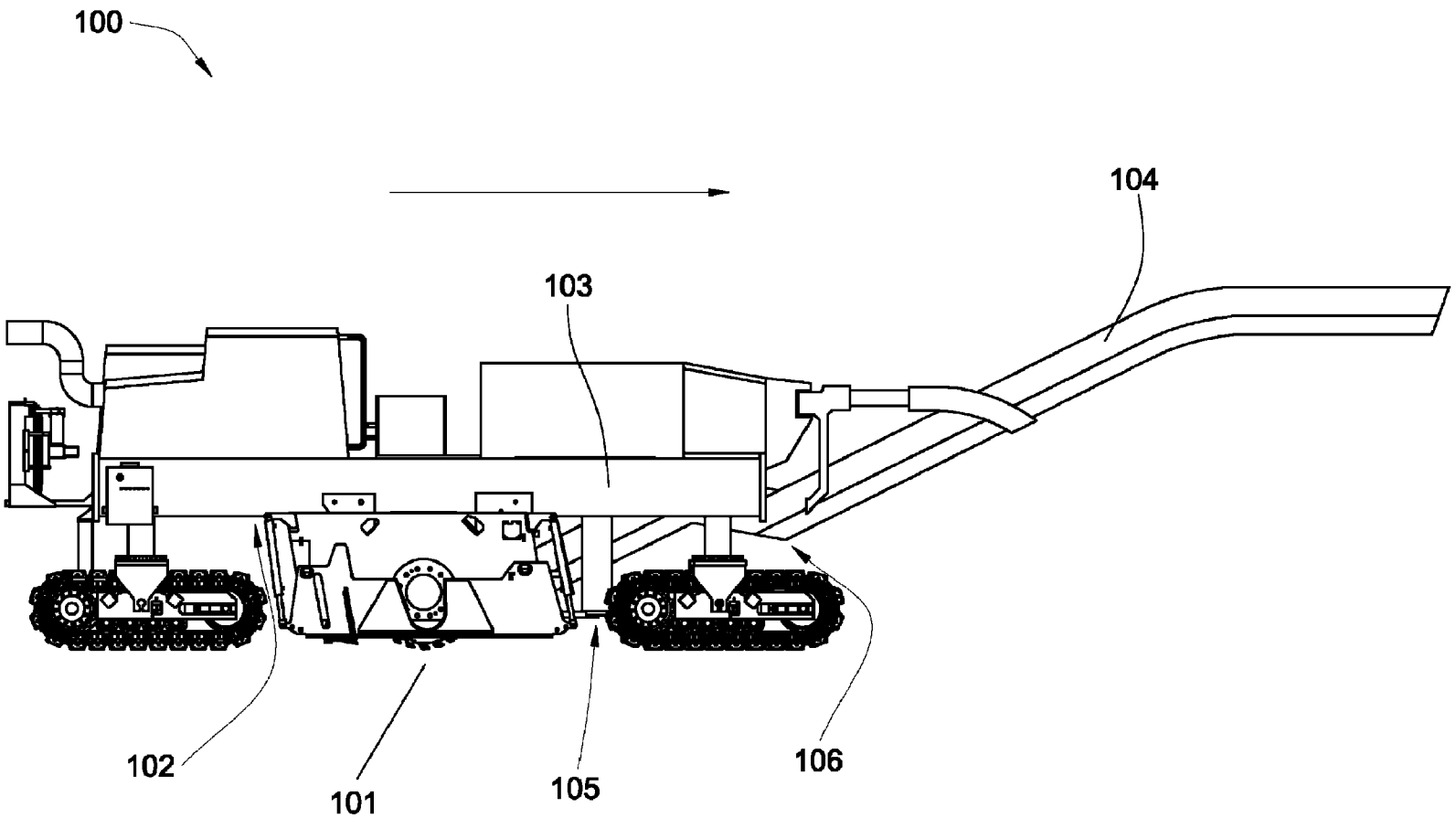
FIG. 1 is an orthogonal diagram of an embodiment of a milling machine.
Figure 2:
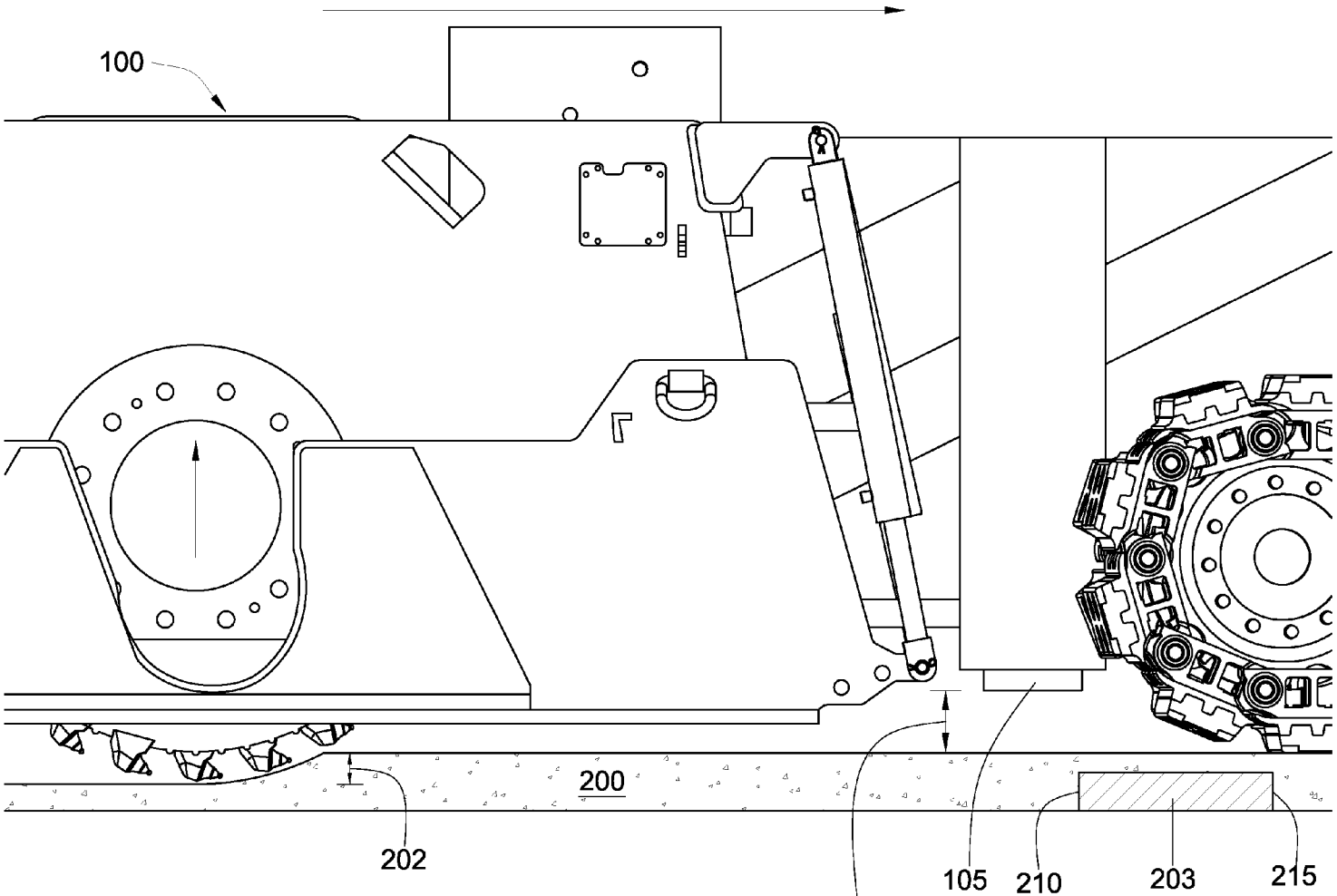
FIG. 2 is an orthogonal diagram of another embodiment of a milling machine.

FIG. 1 depicts a milling machine 100 which may be used to remove asphalt or concrete from a paved surface (see No. 200 in FIG. 2). Milling tools 101 such as a milling drum are attached to an underside 102 of a body 103 of the milling machine 100. A conveyer 104 is adapted to lift the millings off the surface. Typically the millings are loaded into a bed of a truck (not shown) where the millings may be hauled away. The milling machine 100 also comprises at least one metal detector 105 attached to a front end 106 of the machine 100 adapted to detect metal objects, such as manhole covers, in the paved surface at a predetermined detection depth.

Referring now to FIG. 2, the detection depth 201 of the metal detector 105 may be fixed based on a cutting depth 202 of the milling tools 101. After the cutting depth 202 of the milling tools 101 is set, the detection depth 201 of the metal detector 105 may be set at or below the cutting depth 202, such that the metal detector 105 may detect metal objects 203 which may interfere with the cutting of the milling tools 101. The metal detector 105 may be positioned within 8 feet of the milling tools 101. The sensitivity of the metal detector 105 may also be adjustable such that only metal objects 203 large enough to affect the milling may be detected. The detector 105 may be positioned from 0.5 to 8 inches above the paved surface during operation In some embodiments, the metal detector 105 may be adapted to detect metal objects 203 up to 1 foot deep. In other embodiments, the metal detector 105 may be adapted to detect metal objects 203 up to 3 feet deep. The detector 105 may also be adapted to determine the size of the objects.

The detector 105 may emit a magnetic field which extends into the surface 200. As the detector 105 passes over a metal object 203, the magnetic field may induce a magnetic field in the object 203, depending on the material of the metal object 203. The detector 105 may then be able to detect the change in the magnetic field of the object 203, which may indicate a first edge 210 of the object 203. As the metal detector 105 continues to pass over the object 203, the magnetic field of the object 203 may remain constant until the field 301 of the detector 105 reaches a second edge 215 of the object 203, in which instance the magnetic field of the object 203 changes again and is sensed by the detector 105. In such instances, the detector 105 may be able to determine the size of the object 203. In embodiments where the object 203 comprises first and second edges 210, 215 proximate each other, the detector 105 may only briefly induce a magnetic field in the object 203.

When a metal object 203 is detected which may interfere with the milling tools 101, the milling tools 101 may be raised such that the milling tools 101 pass over the metal object 203, as indicated by the vertical arrow 204, which may prevent damage to the metal object 203 and/or the milling tools 101. Other components such as a moldboard 205 may be raised to prevent damage as well. The components may be manually controlled by a machine operator or it may be automatically controlled by electronic equipment in a closed-loop system.

Figure 3:
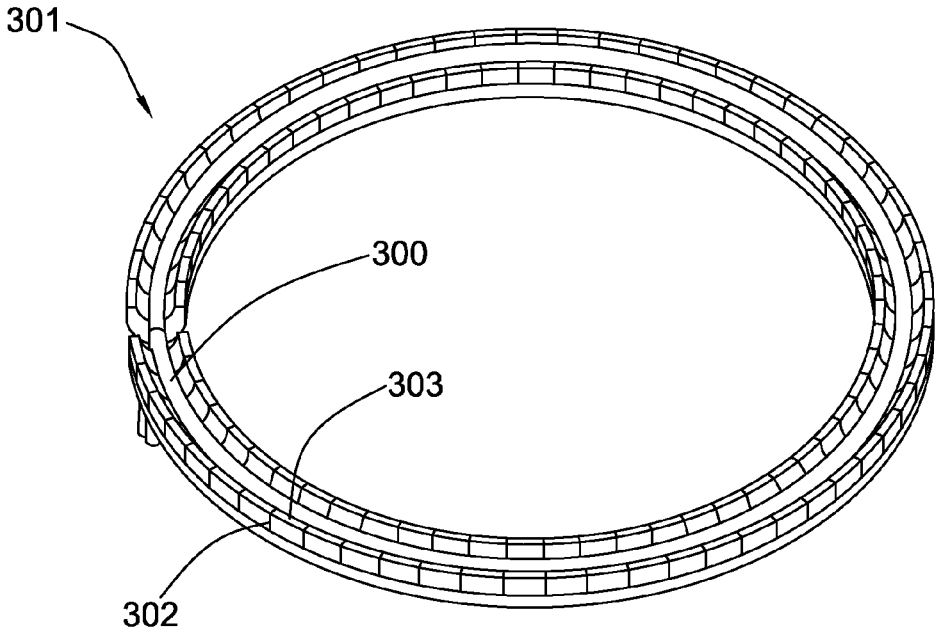
FIG. 3 is a perspective diagram of an embodiment of an embodiment of an electrically conductive coil disposed within a magnetically conducting, electrically insulating trough.

Referring now to the embodiment of FIG. 3, the metal detector 105 comprises an electrically conductive coil 300 disposed within a magnetically conducting, electrically insulating (MCEI) trough 301, such as the coil/trough combination disclosed in U.S. Pat. No. 7,116,199, which is herein incorporated for all that it contains. The coil 300 and trough 301 may be annular, though they may be oval, circular, rectangular, or any polygonal shape. The trough 301 may comprise ferrite, iron, mu-metals, nickel, or combinations thereof. Preferably, the MCEI material comprises a magnetic permeability of at least 100. The MCEI trough 301 may be segmented, wherein gaps 302 are intermediate each of the segments. The segments 303 of the MCEI trough may be held together by a resilient material, such as an epoxy, a natural rubber, a fiberglass or carbon fiber composite, or a polyurethane. The resilient material may fill the gaps 302 between the segments 303 of MCEI material, which may improve the overall durability of the MCEI trough 301.

Figure 4:
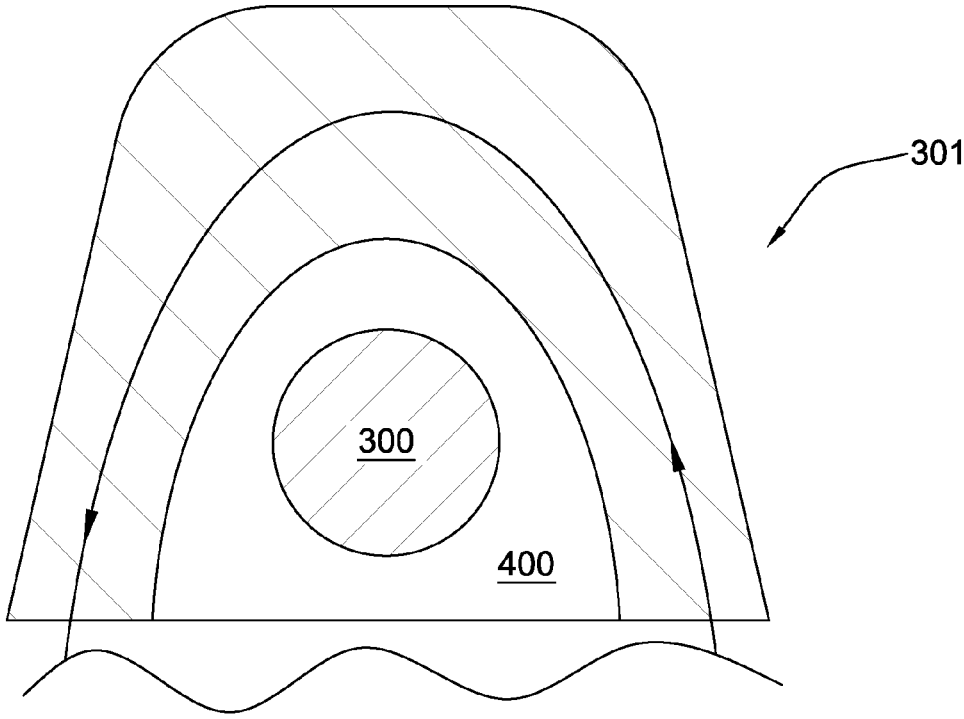
FIG. 4 is a cross-sectional diagram of e embodiment of mother electrically conductive coil disposed within a magnetically conducting, electrically insulating trough.

The electrically conductive coil 300 may be disposed within an electrically insulating material 400 in the trough 301, as in the embodiment of FIG. 4. The material 400 may comprise an epoxy, aluminum oxide, urethanes, or other insulating materials may be used. The insulating material 400 may completely surround the coil 300 within the trough 301. The coil 300 may also be coated with a second insulating material. The second insulating material may be polyketones, polyetheretherketones, PEEK®, or other insulating materials.

As the coil 300 conducts an electrical signal, a magnetic field 401 is created around the coil 300 (though only part of the magnetic field 401 is shown). The MCEI trough 301 may be designed to direct the magnetic field 401 down into the paved surface. This may provide magnetic shielding for the metal detector 105, such that metal on the milling machine 100 which may be proximate the metal detector 105 may not interfere with the metal detector 105.

Figure 5:
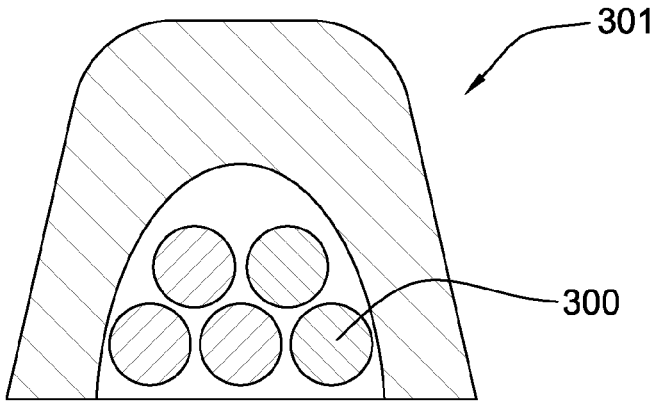
FIG. 5 is a cross-sectional diagram of an embodiment of a plurality of electrically conductive coils disposed within a magnetically conducting, electrically insulating trough.
Figure 6:
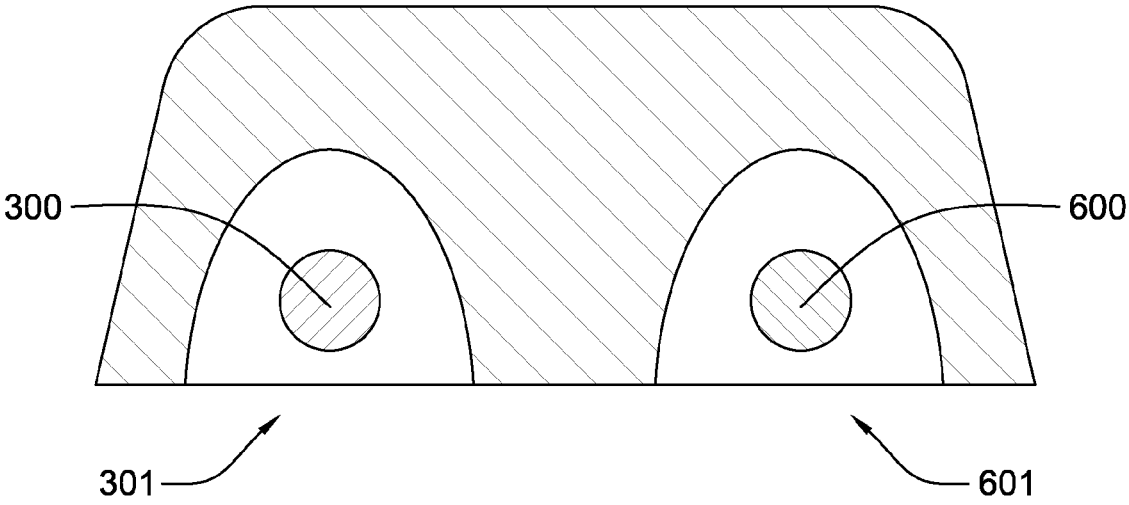
FIG. 6 is a cross-sectional diagram of an embodiment of two electrically conductive coils disposed in separate magnetically conducting, electrically insulating trough.

A plurality of electrically conductive coils 300 may be disposed within the MCEI trough 301, as in the embodiment of FIG. 5. This may allow for the metal detector 105 to emit a stronger signal, which may allow for deeper penetration into the paved surface. A second electrically conductive coil 600 may be disposed within a second MCEI trough 601, as in the embodiment of FIG. 6. The second trough 601 may be concentric with the first trough 301, which may allow for the metal detector 105 to detect objects over a larger range. The second trough 601 may be attached to the first trough 301, or it may be separate. Each trough 301, 601 may comprise different diameters and/or depths.

Figure 7:
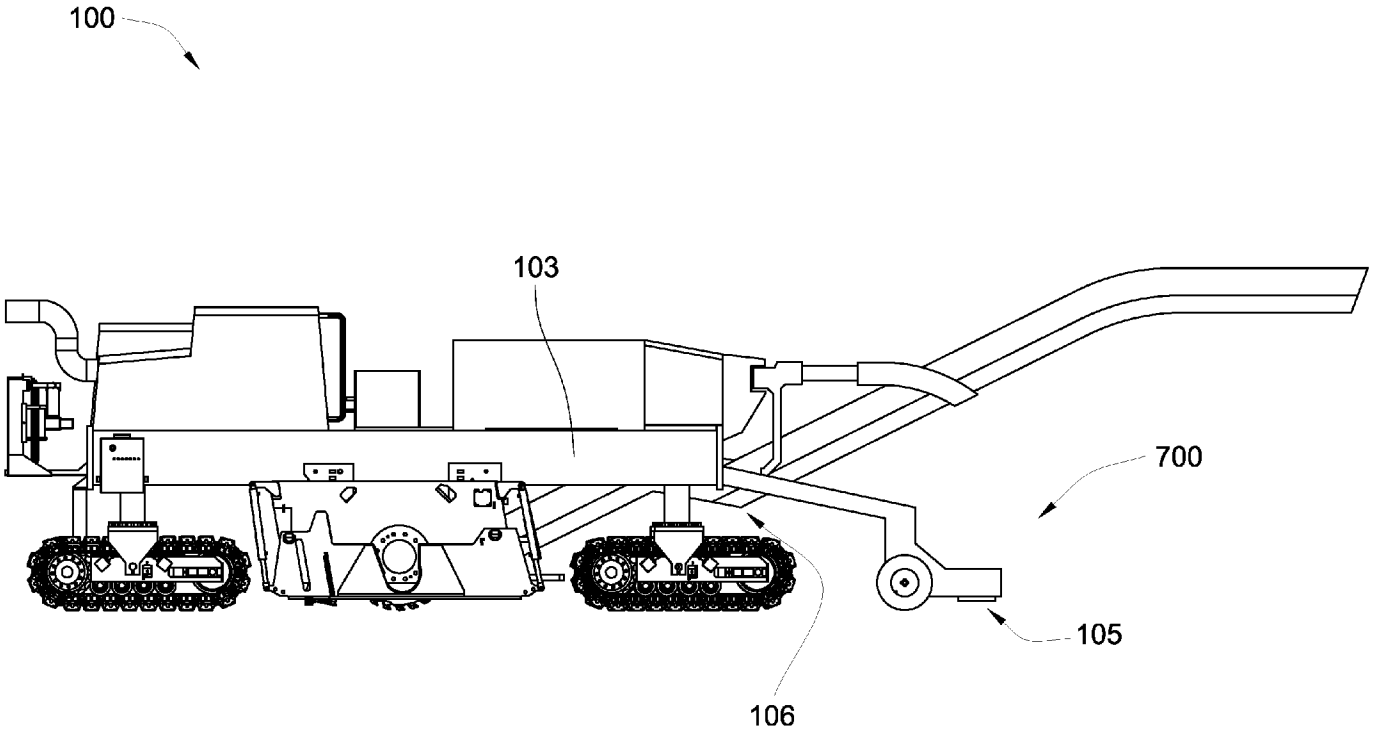
FIG. 7 is an orthogonal diagram of another embodiment of a milling machine.

The detector 105 may be attached at a distance far enough away from the body 103 of the machine 100 such that metal in the body 103 doesn't interfere with the metal detector 105. The machine may comprise an extension 700 on the front end 106 of the machine 100 to which the metal detector 105 may be attached, as in the embodiment of FIG. 7. The extension 700 may comprise wheels 701 and may be pivotally attached to the body 103, which may allow the extension 700 to move along the paved surface such that the detector 105 may maintain a constant height above the paved surface.

Figure 8:
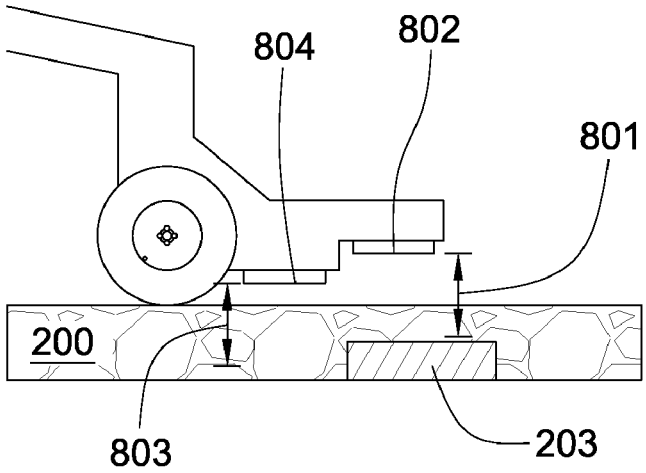
FIG. 8 is an orthogonal diagram of another embodiment of a metal detector.

The machine may comprise a plurality of metal detectors 802, 804. The metal detectors 105 may be arranged in a plurality of arrays 800, such that each array 800 is positioned at a different distance above the surface 200, as in the embodiment of FIG. 8. This may allow for the detectors to detect a depth of a metal object 203 in the paved surface 200. As the detectors pass over where the metal object is covered, if the detection range 801 of a first detector 802 or array of detectors is not deep enough to detect the object 203, the range 803 of a second detector 804 or array may extend deep enough to detect it. From this information, a general depth of the object 203 may be extrapolated. The accuracy of the information may be increased with more detectors. The machine may also comprise a plurality of detectors positioned at a same distance above the paved surface, but calibrated such that each detector has a different detection range, which may allow the detectors to determine the depth of the object.

Figure 9:
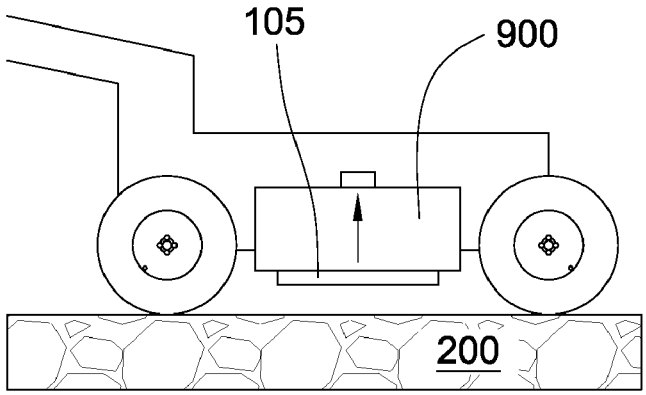
FIG. 9 is an orthogonal diagram of another embodiment of a metal detector.

The metal detector 105 may be attached to a translatable arm 900, as in the embodiment of FIG. 9. The arm 900 may be vertically adjusted such that the detection range of the detector reaches the desired detection depth. This may also be advantageous for determining the depth of objects in the surface 200.

Figure 10:
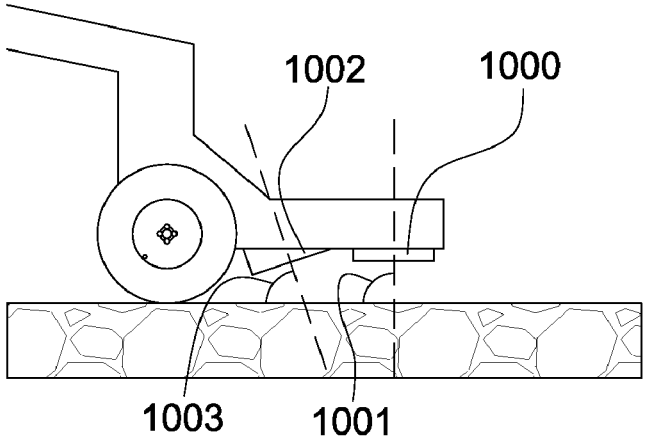
FIG. 10 is an orthogonal diagram of another embodiment of a metal detector.

Another method for determining the depth of metal objects may be triangulation. The machine may comprise a plurality of detectors 1000, 1002 positioned at different angles, as in the embodiment of FIG. 10. A first detector 1000 may be positioned on the extension at a first known angle 1001 with respect to the surface 200, while a second detector 1002 may be positioned at a second known angle 1003 with respect to the surface 200. The machine may also comprise more detectors positioned at other angles for better accuracy. A plurality of detectors may also make it easier to determine the size of the object and/or its shape.

Figure 11:
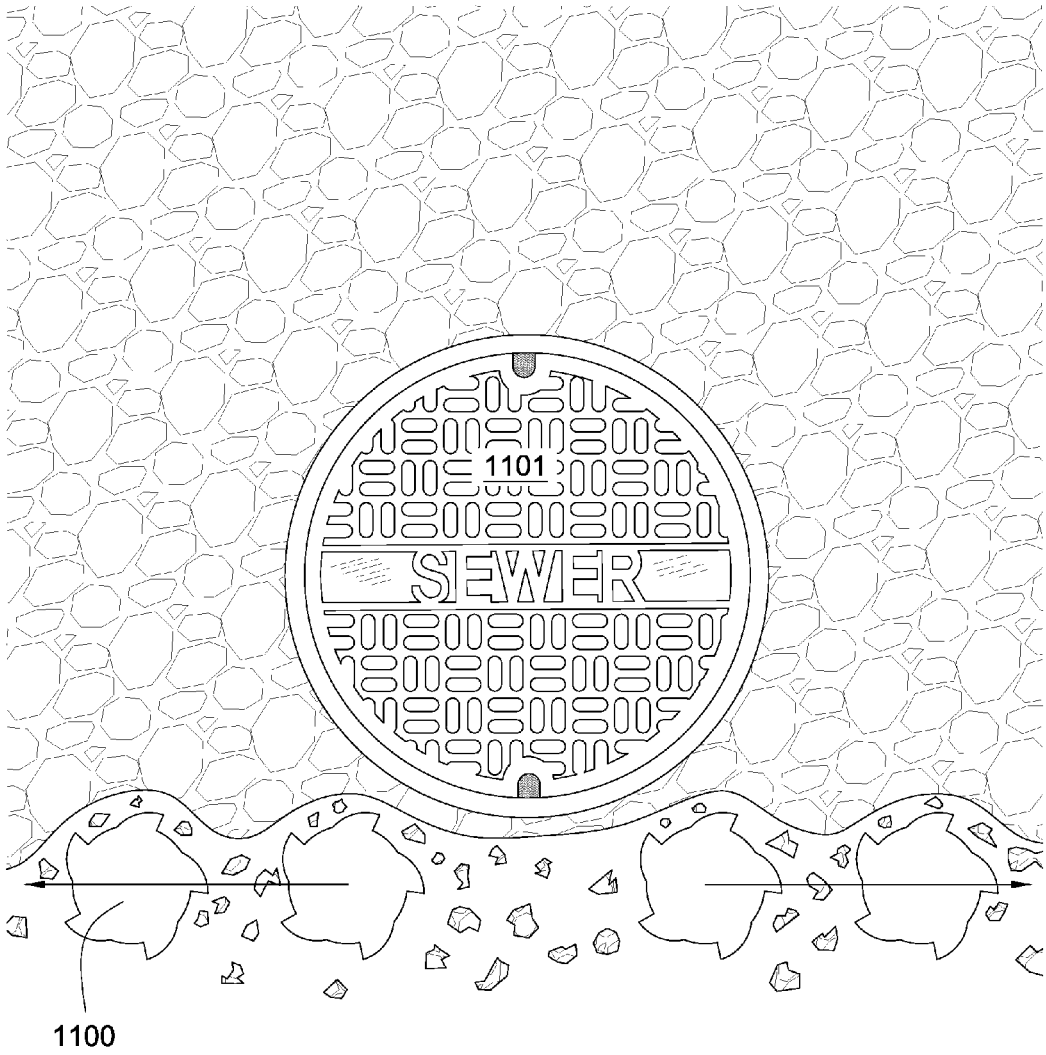
FIG. 11 is a cross-sectional diagram of an embodiment of milling tools milling a paved surface.

The present invention may be used in a milling machine comprising a plurality of rotary bits 1100 as milling tools 101, as in the embodiment of FIG. 11. An example of such a machine that may be compatible with the present invention is disclosed in U.S. Pat. No. 7,223,049 to Hall, which is herein incorporated by reference for all that it discloses. The milling tools may be adapted to be automatically laterally adjusted in a closed-loop system. The detectors 105 may be in electrical communication with electronic equipment in the closed-loop system, such that feedback from the detectors may be used to automatically control the lateral positions of the milling tools. As the detectors pass over a metal object such as a manhole cover 1101, the feedback from the detectors may be interpreted by a processor and stored in memory. Sensors may be positioned on the machine to determine how far the machine travels such that the electronic equipment may be able to determine when a detected metal object reaches the milling tools. The electronic equipment may comprise a controller in electrical communication with the milling tools adapted to control the lateral movement of the milling tools such that the tools may mill around the metal object. The controller may also control the rotation of the tools. The detector may be attached to the front end of the milling machine and proximate the milling tools. The metal detector may be magnetically shielded from the milling tools in addition to being shielded from the body of the machine. The shielding may be attached to the underside of the body.

Figure 12:
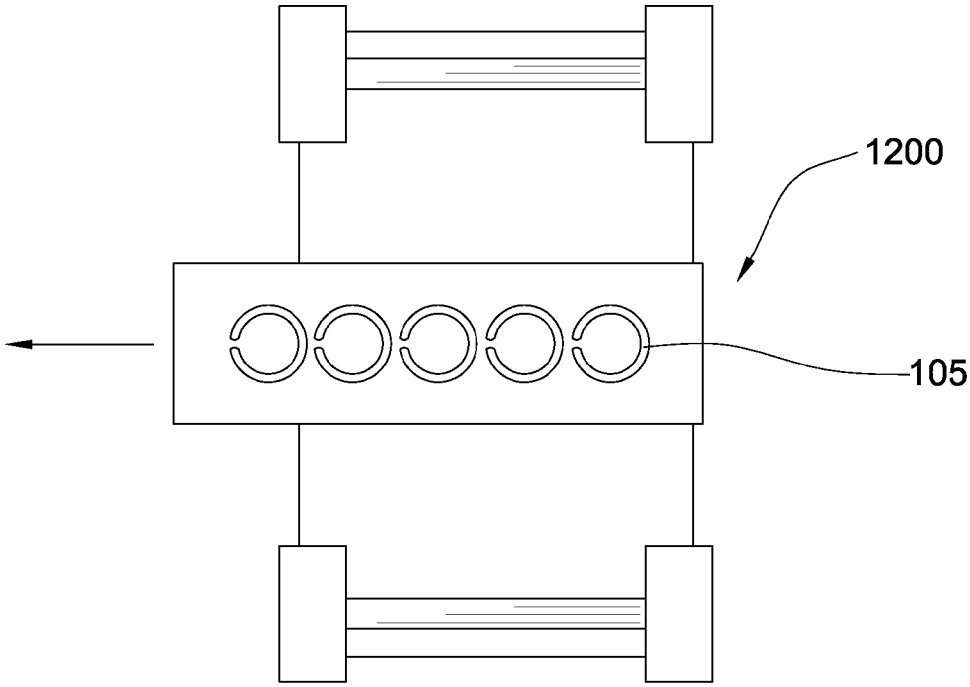
FIG. 12 is an orthogonal diagram of an embodiment of a plurality of metal detectors.
Figure 13:
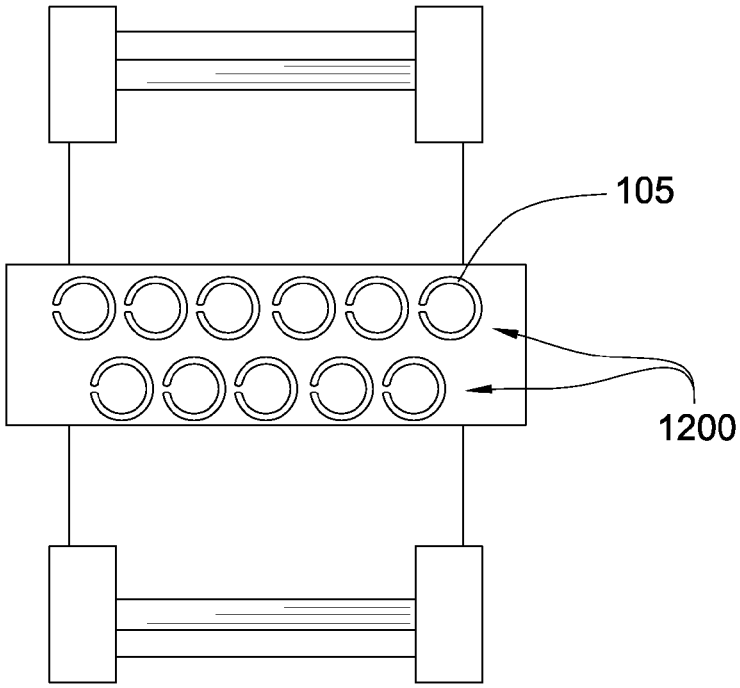
FIG. 13 is an orthogonal diagram of another embodiment of a plurality of metal detectors.

The machine may comprise a plurality of detectors 105 arranged in an array 1200, as in the embodiment of FIG. 12. The array 1200 may be laterally translatable. This may allow the detectors to detect metal objects over a wide pathway, such as on a road. The machine may also comprise a plurality of arrays 1200, 1200 of detectors, as in the embodiment of FIG. 13. The arrays may be staggered such that no lateral gaps are present in the cumulative detection range of all the detectors.

Figure 14:
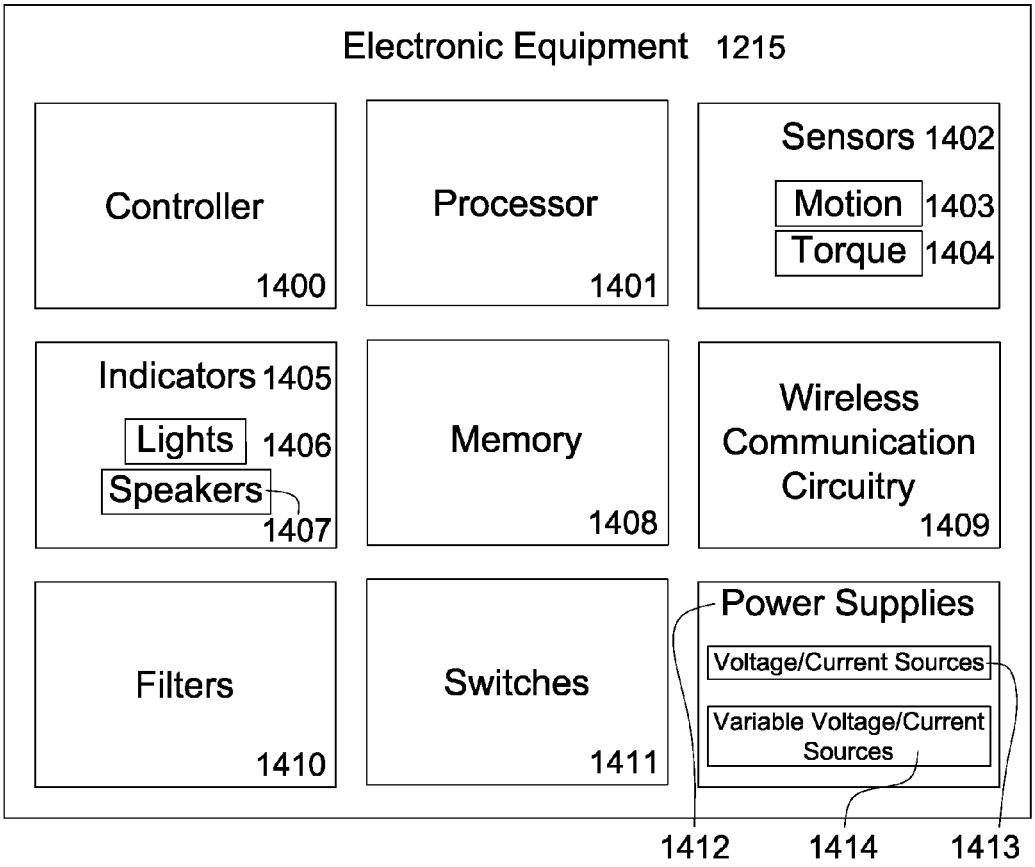
FIG. 14 is a block diagram of an embodiment of electronic equipment in a milling machine.

Referring now to FIG. 14, the electronic equipment 1415 may comprise a controller 1400; a processor 1401; sensors 1402, including motion sensors 1403 or torque sensors 1404; indicators 1405, including lights 1406 or speakers 1407; memory 1408; wireless communication circuitry 1409; filters 1410; switches 1411; or power supplies 1412, including constant or variable voltage/current sources 1413, 1414.

The controller 1400 may control the way the electronic equipment 1415 interacts with mechanical devices such as the milling tools 101 or other elements on the machine. Processors 1401 may be used to process the information and feedback from the detectors 105 or sensors 1402 such as motion sensors 1403 on the machine or torque sensors 1403 on the milling tools for use in a closed-loop system or for use by an operator. The equipment 1415 may comprise memory 1408 for storing the information for use as the machine traverses the paved surface. The information may also later be used for statistical or analytical purposes, or when repaving the surface. When a metal object is detected, indicators 1405 may alert an operator with both lights 1406 and speakers 1407. The electronic equipment 1415 may comprise wireless communication circuitry 1409 such that information gathered by the detectors 105 or sensors 1402 may be transmitted to a remote location. The equipment 1415 may comprise power supplies 1412 such as voltage or current sources 1413, 1414, which may either be constant or variable for powering the detectors 105 or sensors 1402. The equipment 1415 may also comprise filters 1410, switches 1411, or other electronic devices for performing such functions as determining the type of ferrous metal of the object.

Whereas the present invention has been described in particular relation to the drawings attached hereto, it should be understood that other and further modifications apart from those shown or suggested herein, may be made within the scope and spirit of the present invention.

What is claimed is:

1. A milling machine for milling a paved surface, comprising:

milling tools connected to an underside of a body of the machine;

at least one metal detector attached to a front end of the machine, the metal detector comprising at least one first electrically conductive coil disposed within a first magnetically conducting, electrically insulating trough comprising ferrite; and electronic equipment in communication with the metal detector, the equipment being adapted to interpret feedback from the detector;

wherein the metal detector further comprises a second electrically conductive coil disposed within a second magnetically conducting, electrically insulating trough comprising ferrite and the second trough is concentric and coplanar with the first trough.

2. The machine of claim 1, wherein the machine comprises at least two metal detectors positioned such that a detection range of a first detector extends farther into the surface than a detection range of a second detector.

3. The machine of claim 1, wherein the metal detector comprises at least 2 electrically conductive coils disposed within a magnetically conducting, electrically insulating trough.

4. The machine of claim 1, wherein a detection range of the metal detector is controlled by a variable voltage source.

5. The machine of claim 1, wherein the metal detector is adapted to detect metal objects up to 1 foot deep.

6. The machine of claim 1, wherein the metal detector is adapted to determine the size of a metal object.

7. The machine of claim 1, wherein the machine comprises a plurality of metal detectors arranged in a plurality of arrays, each array positioned at a different distance above the paved surface.

8. The machine of claim 1, wherein the milling tools are adapted to be automatically laterally adjusted in a closed-loop system by the electronic equipment in response to feedback from the detector.

9. The machine of claim 1, wherein the machine comprises a plurality of metal detectors positioned at different angles.

10. The machine of claim 1, wherein the metal detector is vertically adjustable.

11. The machine of claim 1, wherein the metal detector is attached to the front end such that during operation the detector is positioned from 0.5 to 8 inches above the paved surface.

12. The machine of claim 1, wherein the magnetically conducting, electrically insulating trough is segmented.

13. The machine of claim 1, wherein the metal detector is also positioned within 8 feet of the milling tools.

14. The machine of claim 1, wherein the coil is coated with polyketones, PEEK, or other insulating materials.

15. The machine of claim 1, wherein the magnetically conducting, electrically insulating trough comprises a magnetic permeability of at least 100.

16. The machine of claim 1, wherein the machine comprises at least two metal detectors, each adapted to detect metal objects at different depths.

17. The machine of claim 1, wherein the coil is circular, rectangular, or any polygonal shape.

* * * * *